US010260805B2

(12) United States Patent
Yoshinuma

(10) Patent No.: US 10,260,805 B2
(45) Date of Patent: Apr. 16, 2019

(54) HEATING APPARATUS, DRYER, AND PRINTER

(71) Applicant: Toshihiro Yoshinuma, Kanagawa (JP)

(72) Inventor: Toshihiro Yoshinuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/921,620

(22) Filed: Mar. 14, 2018

(65) Prior Publication Data

US 2018/0266763 A1 Sep. 20, 2018

(30) Foreign Application Priority Data

Mar. 17, 2017 (JP) ..... 2017-053307
Feb. 21, 2018 (JP) ..... 2018-028454

(51) Int. Cl.

| | |
|---|---|
| ***F26B 3/20*** | (2006.01) |
| ***F26B 21/06*** | (2006.01) |
| ***B41J 11/00*** | (2006.01) |
| ***F26B 15/12*** | (2006.01) |
| ***F26B 21/00*** | (2006.01) |
| *B41M 7/00* | (2006.01) |

(52) U.S. Cl.

CPC ..... *F26B 3/20* (2013.01); *B41J 11/002* (2013.01); *F26B 15/12* (2013.01); *F26B 21/004* (2013.01); *F26B 21/06* (2013.01); *B41M 7/009* (2013.01)

(58) Field of Classification Search

CPC ..... F26B 3/20; F26B 21/004; F26B 21/06; F26B 15/12; B41M 7/009; B41J 11/002

See application file for complete search history.

(56) References Cited

U.S. PATENT DOCUMENTS

| | | | | |
|---|---|---|---|---|
| 5,287,123 | A * | 2/1994 | Medin | B41J 11/002 347/102 |
| 2012/0050372 | A1* | 3/2012 | Yamaguchi | B41J 11/002 347/16 |
| 2012/0069110 | A1* | 3/2012 | Nakazawa | B41J 11/002 347/102 |
| 2014/0092184 | A1 | 4/2014 | Walker et al. | |
| 2014/0210919 | A1* | 7/2014 | Walker | B41J 11/002 347/102 |
| 2016/0273832 | A1 | 9/2016 | Asada et al. | |
| 2017/0120625 | A1 | 5/2017 | Yoshinuma | |
| 2017/0266990 | A1 | 9/2017 | Yoshinuma et al. | |

(Continued)

FOREIGN PATENT DOCUMENTS

| | | |
|---|---|---|
| JP | 8-285456 | 11/1996 |
| JP | 2006-167278 | 6/2006 |

(Continued)

*Primary Examiner* — Henok D Legesse
(74) *Attorney, Agent, or Firm* — Duft & Bornsen, PC

(57) ABSTRACT

A heating apparatus includes a plurality of heaters to heat a heating object, a plurality of air nozzles to blow air onto the heating object, and a blower to supply air to the plurality of air nozzles. The plurality of heaters is disposed along a conveyance direction of the heating object, at least one of the plurality of air nozzles is disposed between adjacent two of the plurality of heaters, and the plurality of air nozzles blows air onto the heating object while the plurality of heaters heats the heating object in both cases of when the heater performs a heating operation and when the heater does not perform the heating operation.

7 Claims, 3 Drawing Sheets

(56) References Cited

U.S. PATENT DOCUMENTS

| | | | |
|---|---|---|---|
| 2017/0266991 | A1 | 9/2017 | Onodera et al. |
| 2017/0334217 | A1 | 11/2017 | Yoshinuma et al. |
| 2018/0022114 | A1 | 1/2018 | Sakamoto et al. |

FOREIGN PATENT DOCUMENTS

| | | |
|---|---|---|
| JP | 2014-148168 | 8/2014 |
| JP | 2016-168805 | 9/2016 |

* cited by examiner

HEATING APPARATUS, DRYER, AND PRINTER

CROSS-REFERENCE TO RELATED APPLICATIONS

This patent application is based on and claims priority pursuant to 35 U.S.C. § 119(a) to Japanese Patent Application No. 2017-053307, filed on Mar. 17, 2017, and Japanese Patent Application No. 2018-028454, filed on Feb. 21, 2018 in the Japan Patent Office, the entire disclosure of which are hereby incorporated by reference herein.

BACKGROUND

Technical Field

Aspects of the present disclosure generally relate to a heating apparatus, a dryer, and a printer.

Related Art

As a printer that performs printing by applying a liquid to a medium such as a roll paper, a continuous paper, and a belt-like continuous body (web), there is a printer that includes a dryer to promote drying of the liquid applied on the medium.

For example, there is a device in which a plurality of heating elements are arranged in a feeding direction of a print medium and a flow generator for jetting a cooling gas is disposed between the heating elements. The printing medium is heated by the plurality of heating elements, and the heated gas is deflected by colliding the cooling gas from the flow generator against the printing medium.

SUMMARY

In an aspect of this disclosure, a heating apparatus includes a plurality of heaters to heat a heating object, a plurality of air nozzles to blow air onto the heating object, and a blower to supply air to the plurality of air nozzles. The plurality of heaters is disposed along a conveyance direction of the heating object, at least one of the plurality of air nozzles is disposed between adjacent two of the plurality of heaters, and the plurality of air nozzles blows air onto the heating object while the plurality of heaters heats the heating object in both cases of when the heater performs a heating operation and when the heater does not perform the heating operation.

In another aspect of this disclosure, a dryer includes the heating apparatus as described above to dry the heating object.

In still another aspect of this disclosure, a printer includes the dryer as described above, and a liquid application unit to apply liquid to the heating object before the heating object is conveyed to the dryer.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
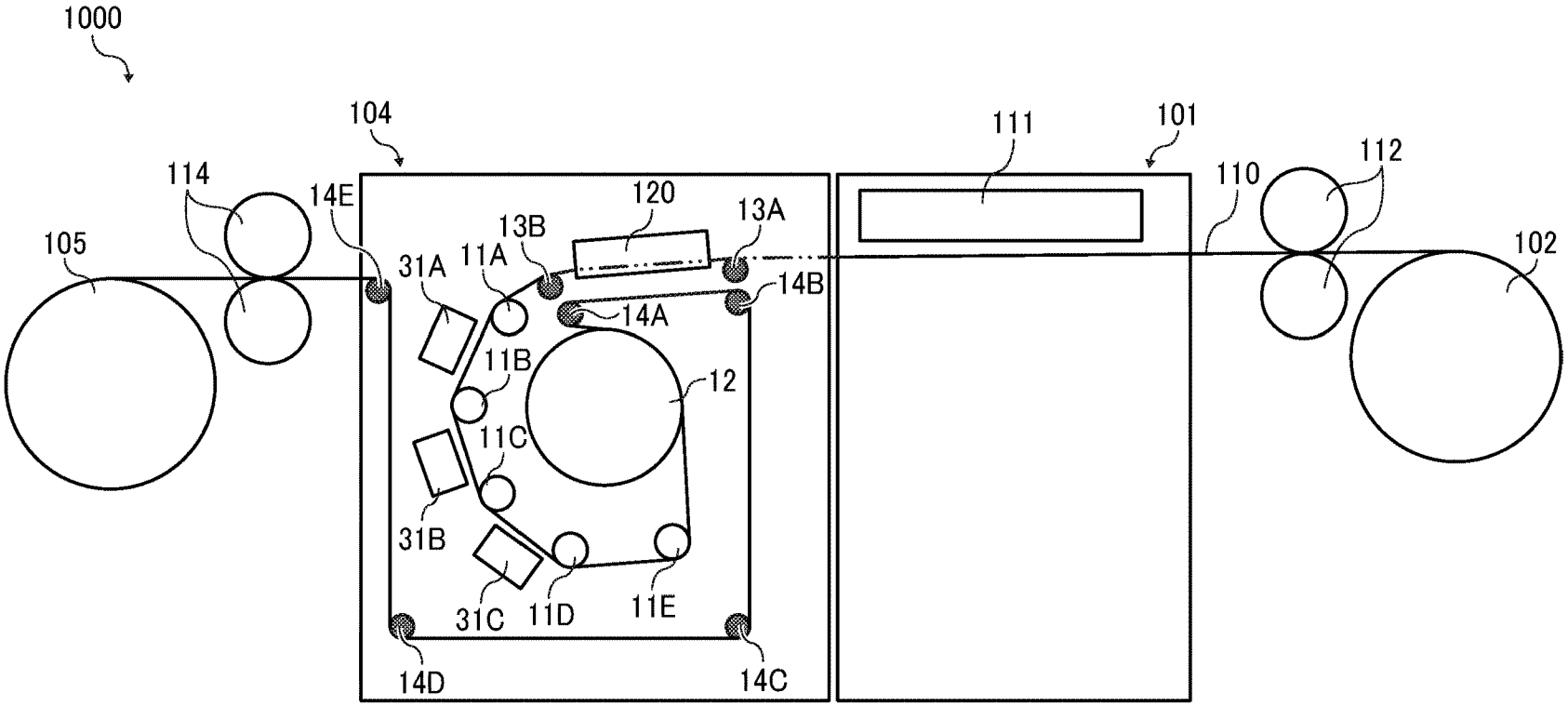
FIG. 1 is a schematic cross-sectional view of a printer according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Hereinafter, embodiments of the present disclosure are described with reference to the attached drawings. A liquid discharge head according to an embodiment of the present disclosure is described with reference to FIGS. 1 through 3.

Referring now to the drawings, embodiments of the present disclosure are described below wherein like reference numerals designate identical or corresponding parts throughout the several views. A printer 1000 according to a first embodiment of the present disclosure is described with reference to FIG. 1. FIG. 1 is a schematic cross-sectional view of the printer 1000.

The printer 1000 is an inkjet recording apparatus, and includes a liquid application unit 101 including a liquid discharge head 111, which is a liquid applicator, to discharge and apply ink onto a continuous sheet 110. The ink is liquid of desired colors. The continuous sheet 110 is a member (conveyed medium or heating object) to be conveyed. Hereinafter, "the liquid discharge head" is simply referred to as the "the head".

The liquid application unit 101 includes, for example, full-line liquid discharge heads 111 of four colors are disposed in an order of black (K), Cyan (C), Magenta (M), and Yellow (Y) from the upstream side in a medium conveyance direction (MCD) of the continuous sheet 110. The liquid discharge heads 111 respectively apply liquids of black (K), cyan (C), magenta (M), and yellow (Y) onto the continuous sheet 110. Note that the number and types of color are not limited to the above-described four colors of K, C, M, and Y and may be any other suitable number and types.

The continuous sheet 110 fed from a feeding roller 102 is conveyed to a position facing the liquid application unit 101 by conveyance rollers 112.

The continuous sheet 110 onto which the liquid is applied by the liquid application unit 101 is sent by ejection rollers 114 through a dryer 104 according to the present embodiment, and is wound around a winding roller 105.

Next, the dryer 104 according to the present embodiment is further described below.

The dryer 104 includes at least one (here, five) heating rollers 11 (11A to 11E) and a heating drum 12 disposed along a conveyance direction of the continuous sheet 110. The heating rollers 11 to contact and heat a second surface opposite a first surface of the continuous sheet 110 on which the liquid is applied. The heating drum 12 has a diameter larger than diameters of the heating rollers 11.

Further, the dryer 104 includes at least one (here, two) guide rollers 13 (13A and 13B) for guiding the continuous sheet 110 passed through the liquid application unit 101 to the heating roller 11A. Further, the dryer 104 includes at least one (here, five) guide rollers 14 (14A to 14E) for guiding the continuous sheet 110 passed through the heating drum 12 to the ejection rollers 114 disposed downstream of the dryer 104.

A heating apparatus 120 is disposed between the guide roller 13A and the guide roller 13B. The heating apparatus 120 according to the present embodiment heats the continuous sheet 110 that is the heating object, to which the liquid is applied and conveyed. Non-contact heaters 31A, 31B, 31C, and 31D such as a hot air dryer for drying the continuous sheet 110 are disposed at spaces between the heating rollers 11A and 11B, 11B and 11C, 11C and 11D, and 11D and 11E, respectively.

Figure 2:
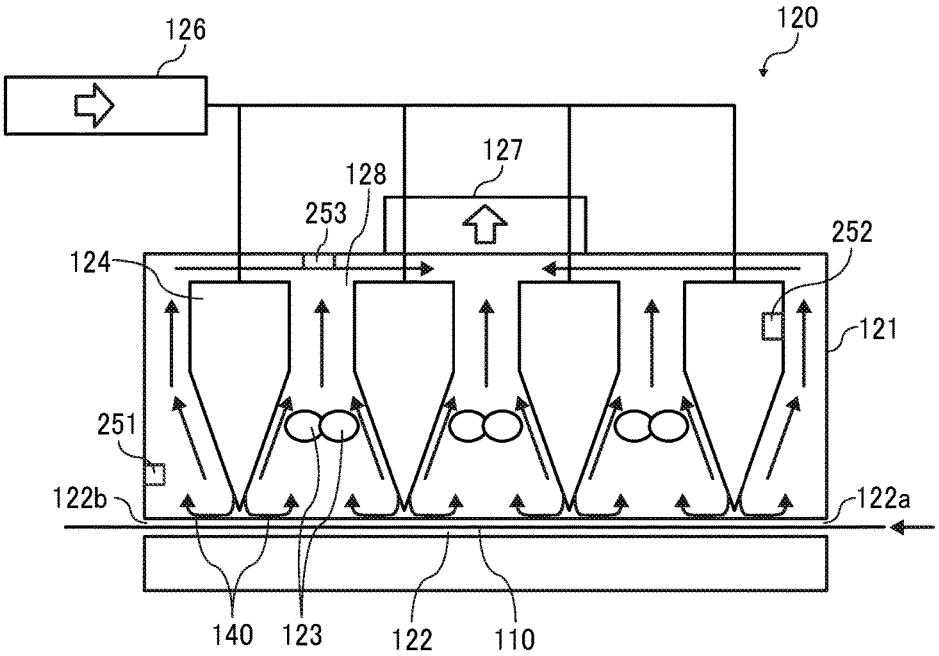
FIG. 2 is a schematic cross-sectional view of a heater according to a first embodiment of the present disclosure along a feeding direction of medium.

The heating apparatus 120 of the dryer 104 according a first embodiment of the present disclosure is described in detail below with reference to FIG. 2. FIG. 2 is a schematic cross-sectional view of the heating apparatus 120 along the conveyance direction of the continuous sheet 110.

The heating apparatus 120 is a radiant heater, and includes a conveyance path 122, an entrance 122*a*, and an exit 122*b* in a housing (enclosure) 121. The continuous sheet 110 is conveyed along the conveyance path 122. The entrance 122*a* and the exit 122*b* are disposed each ends of the conveyance path 122 in the housing 121.

Further, the heating apparatus 120 includes a plurality of infrared heaters 123 (heaters) and a plurality of air knives (air nozzles) 124 in the housing 121. The plurality of infrared heaters 123 serving as a heater for heating the continuous sheet 110 to be conveyed (moved). The plurality of air knives (air nozzles) serving as an air blower for blowing air onto the continuous sheet 110.

The air knife 124 has an elongated shape in a width direction perpendicular to a conveyance direction of the continuous sheet 110. The air knife 124 includes an air chamber to which air is supplied from outside and a slit-shaped blowout port (nozzle).

The plurality of infrared heaters 123 is arranged in a row along the conveyance direction (moving direction) of the continuous sheet 110. The air knives 124 are disposed on an upstream end and a downstream end of the entire rows of the infrared heaters 123 in the conveyance direction of the continuous sheet 110 and between the adjacent infrared heaters 123, respectively. In other words, the air knives 124 are disposed both sides of each of the infrared heaters 123 in the conveyance direction of the continuous sheet 110 such that two air knives 124 sandwich one pair of infrared heaters 123 as illustrated in FIG. 2.

A blower fan 126 is connected to each of the air knives 124. The blower fan 126 serves as a blower and is also referred to as an airflow generator. Air is supplied to the blowout port (nozzle) during rotation of the blower fan 126, that is, while supplying air to the air knives 124 (airflow generating operation). Then, the air 140 is blown out from the blowout port (nozzle) and is blown onto the continuous sheet 110 as the heating object. Although the blower fan 126 is commonly connected to the plurality of air knives 124, the blower fan 126 may be provided individually for each air knives 124.

Figure 4:
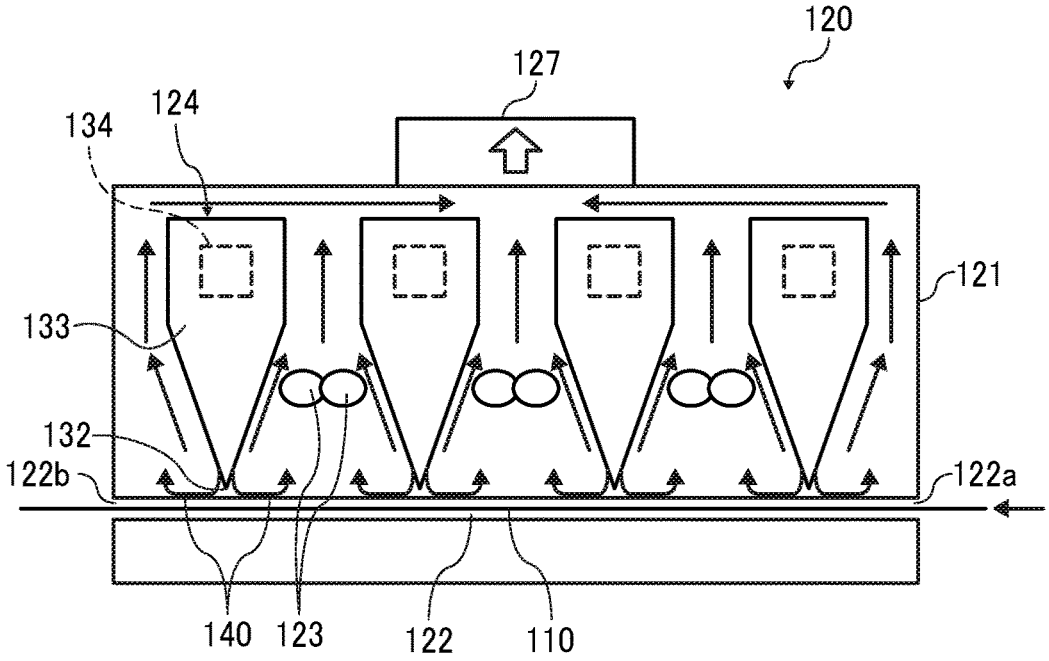
FIG. 4 is a schematic cross-sectional view of a heater according to another embodiment of the present disclosure.
Figure 5:
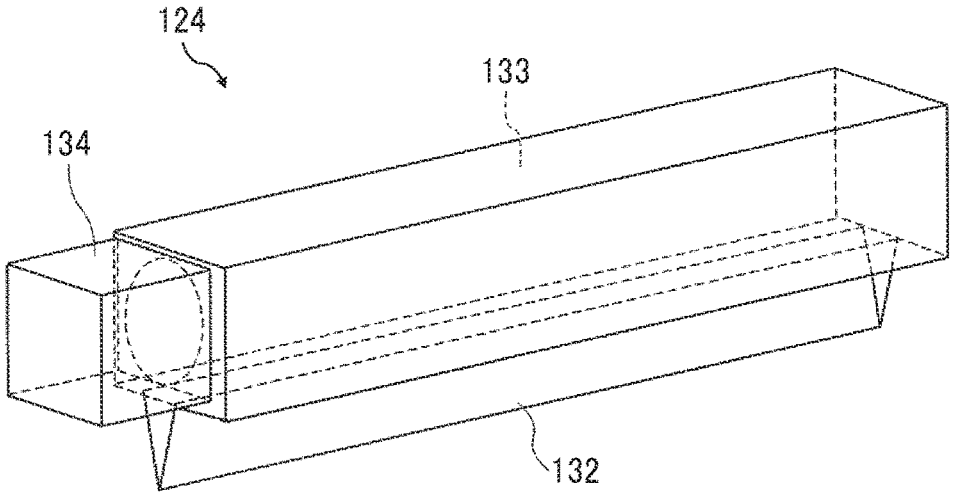
FIG. 5 is a perspective view of an air knife of the heater in FIG. 4.

Another example of a heating apparatus 120 is described below with reference to FIGS. 4 and 5. The heating apparatus 120 includes a blower fan 134 for each of air knives 124. FIG. 4 is a schematic cross-sectional view of the heating apparatus 120 along the conveyance direction of the continuous sheet 110. FIG. 5 is a perspective view of the air knife 124 of the heating apparatus 120 in FIG. 4.

In this heating apparatus 120, a plurality of air knives 124 is arranged along the conveyance direction (moving direction) of the continuous sheet 110. Each of the plurality of air knives includes a blower fan 134.

As illustrated in FIG. 5, the air knife 124 includes an elongated air chamber 133 and a nozzle 132 communicating with the air chamber 133. A blower fan 134 is provided at an end of the air chamber 133 in a longitudinal direction of the air chamber 133. The blower fan 134 may also be provided on the upper center of the air chamber 133 in the longitudinal direction of the air knife 124.

In FIG. 2 (also in FIG. 4), an exhaust fan 127 (exhaust) for discharging the air in the housing 121 is disposed in the housing 121.

Figure 3:
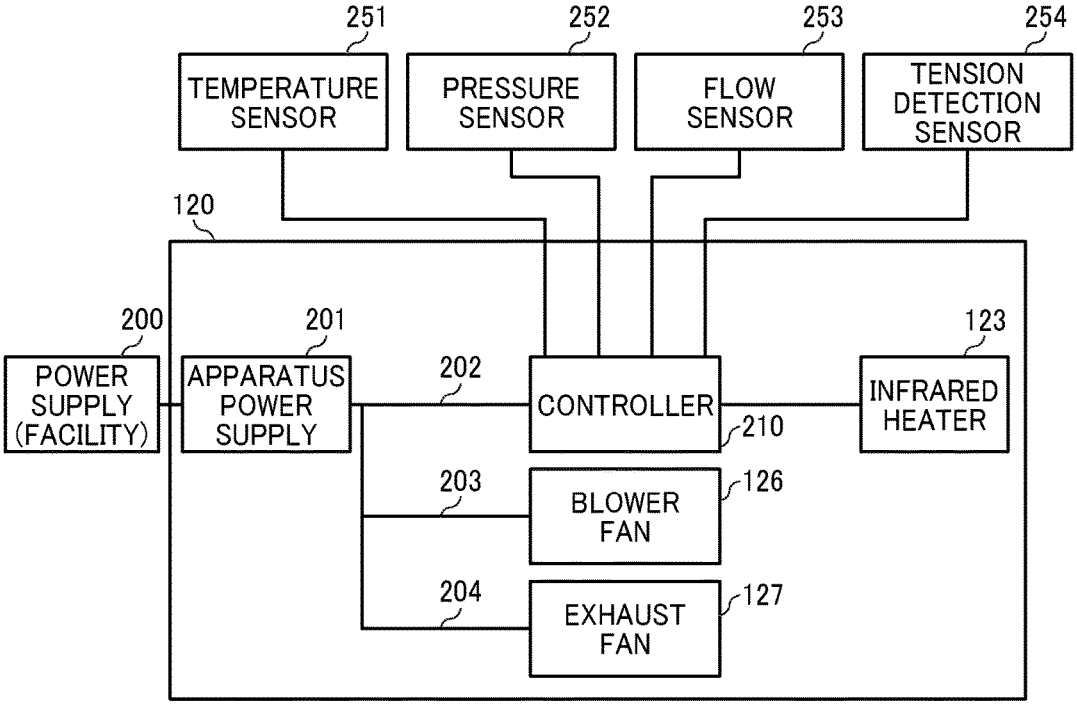
FIG. 3 is a block diagram of the heater illustrating a power supply system of the heater.

Next, a power supply system of the heating apparatus according to the first embodiment of the present embodiment is described with reference to the block diagram of FIG. 3. Here, although the heating apparatus 120 in FIG. 2 is used for an explanation, the heating apparatus 120 in FIG. 4 can also be applied in the present embodiment.

The heating apparatus 120 includes an apparatus power supply 201. Power is supplied from an external power supply equipment (commercial power supply, for example) 200 to the apparatus power supply 201. The heating apparatus 120 includes a controller 210 that controls the heating operation of the infrared heater 123. The apparatus power supply 201 supplies power to the controller 210 via a first power supply route 202, supplies power to the blower fan 126 (blower) via a second power supply route 203, and supplies power to the exhaust fan 127 via a third power supply route 204. The first power supply route 202, the second power supply route 203, and the third power supply route 204 are separate systems.

Here, an operation of turning ON and turning OFF the power supply to the blower fan 126 and the exhaust fan 127 are performed by turning ON and turning OFF the apparatus power supply 201, respectively. When the apparatus power supply 201 is in an ON state, the power is supplied to the blower fan 126 and the exhaust fan 127.

In this case, when the blower fan 126 is a fan using PWM (Pulse Width Modulation) control, for example, power is supplied to the blower fan 126 even if the PWM signal has the lowest duty of 0%. Thus, an operation of supplying air to the air knife 124 (airflow generation operation, intake operation) is continued.

If the exhaust fan 127 is also a fan by PWM control, the exhaust operation is continued without stopping because the power supply is being performed even if the PWM signal has the lowest duty 0%.

The blower fan 126 thus configured continues air blowing operation as long as the apparatus power supply 201 is not turned off. That is, the blower fan 126 continues air blowing operation as long as the infrared heater 123 performing a heating operation (operation of generating radiant heat). The blower fan 126 serves as a blower. That is, the blower fan 126 performs the air blowing operation in both cases of when the infrared heater 123 performs the heating operation and when the infrared heater does not perform the heating operation when the apparatus power supply 201 is in the ON state.

Thus, the plurality of heaters (infrared heaters 123) is disposed along a conveyance direction of the heating object (continuous sheet 110), at least one of the plurality of air nozzles (air knives 124) is disposed between adjacent two of the plurality of heaters (infrared heaters 123). The plurality of air nozzles (air knives 124) blows air onto the heating object (continuous sheet 110) while the plurality of heaters (infrared heaters 123) heats the heating object (continuous sheet 110) in both cases of when the heater (infrared heaters 123) performs the heating operation and when the heater (infrared heaters 123) does not perform the heating operation.

The blower (blower fan 126) supplies the air to the nozzle 132 of the plurality of air nozzles (air knives 124) in both cases of when the plurality of heaters (infrared heaters 123) performs the heating operation and when the plurality of heaters (infrared heaters 123) does not perform the heating operation while the apparatus power supply 201 is turned on.

Therefore, the air 140 is constantly (continuously) blown onto the continuous sheet 110 from the air knife 124 when the infrared heater 123 performs the heating operation. The air blown onto the continuous sheet 110 passes through the periphery of the infrared heater 123 and is discharged outside the housing 121 by the exhaust fan 127 since the exhaust fan 127 also constantly (continuously) performs the exhaust operation.

Thus, an exhaust fan 127 (exhaust) for discharging the air 140 blown onto the heating object (continuous sheet 110) outside the heating apparatus 120, and the exhaust fan 127 (exhaust) discharges the air 140 outside the heating apparatus 120 in both cases of when the heater (infrared heater 123) performs the heating operation and when the heater (infrared heater 123) does not perform the heating operation while the apparatus power supply 201 is turned on. The power supplied to the exhaust fan 127 is controlled by turning on or turning off the apparatus power supply 201.

In this case, a part of an exhaust path leading to the exhaust fan 127 is formed between the adjacent air knives 124 (air nozzles).

Thus, the air 140 is blown onto the continuous sheet 110 from the air knife 124 to suppress an excessive temperature rise when the infrared heater 123 performs the heating operation even though the conveyance of the continuous sheet 110 is stopped. Therefore, when the heating object is a printing medium to be printed by a printing apparatus, yellowing of the printing medium and deterioration of the image on the printing medium are prevented.

The air knives 124 are disposed on the upstream end and the downstream end of the entire rows of the infrared heaters 123 in the conveyance direction of the continuous sheet 110 and between the adjacent infrared heaters 123, respectively. In other words, the air knives 124 are disposed both sides of each of the infrared heaters 123 in the conveyance direction of the continuous sheet 110 such that two air knives 124 sandwich one pair of infrared heaters 123 as illustrated in FIG. 2.

Thus, excessive temperature rise can be suppressed against the infrared heater 123 disposed at the most upstream in the moving direction of the continuous sheet 110 and the infrared heater 123 disposed at the most downstream.

As illustrated in FIG. 2, the heating apparatus 120 includes a temperature sensor 251, a pressure sensor 252, a flow sensor 253, and a tension detection sensor 254. The temperature sensor 251 detects temperature inside the housing 121. The pressure sensor 252 detects a pressure inside the air knife 124. The flow sensor detects airflow (air volume) in the exhaust path 128 to be discharged to the exhaust fan 127.

Various detection signals of the temperature sensor 251, the pressure sensor 252, and the flow sensor 253 are input to the controller 210. Further, a detection signal of the tension detection sensor 254 for detecting a tension of the continuous sheet 110 is also input to the controller 210. Thus, the controller 210 can detect that the continuous sheet 110 is stopped when the tension detection sensor 254 detects a decrease in tension.

The controller 210 controls to stop the power supply to the infrared heater 123 when the controller 210 controls the heating operation of the infrared heater 123 with the following conditions.

(1) When it is detected that the conveyance of the continuous sheet 110 is stopped.

(2) When the temperature sensor 251 detects that the temperature inside the heating apparatus 120 becomes equal to or higher than the predetermined temperature.

(3) When the tension detection sensor 254 detects that the continuous sheet 110 is damaged (occurrence of web break).

(4) When the pressure sensor 252 detects the pressure of the air in the air knife 124 and detects that the air knife 124 is stopped.

(5) When the flow sensor 253 detects the airflow in the exhaust path and detects that air exhaustion is stopped.

(6) When rotational speeds of the blower fan 126 and the exhaust fan 127 are lower than a target rotational speed, and so on.

That is, the controller 210 uses a tension detection sensor 254 to detecting whether there is a tension of the continuous sheet 110. The controller 210 can detect whether the conveyance of the continuous sheet 110 is stopped from the existence of the tension of the continuous sheet 110. The controller 210 stops power supply to the infrared heater 123 when the tension detection sensor 254 does not detect the tension of the continuous sheet 110.

Further, the controller 210 controls to stop power supply to the infrared heater 123 when a detection temperature detected by the temperature sensor 251 provided in the housing 121 of the heating apparatus 120 becomes equal to or higher than a predetermined setting temperature.

Further, the controller 210 controls to stop power supply to the infrared heater 123 when a pressure value detected by the pressure sensor 252 provided inside the air knife 124 becomes equal to or less than a predetermined value.

Further, the controller 210 controls to stop power supply to the infrared heater 123 when an airflow rate measured in the exhaust path 128 in the housing 121 of the heating apparatus 120 by the flow sensor 253 becomes equal to or less than a predetermined value.

The controller 210 can stop the power supply to the infrared heater 123 by sending a stop signal to the infrared heater 123.

Further, a thermostat may be used to mechanically shut off a power supply route to the infrared heater 123.

The controller 210 can suppress the excessive temperature rise by the air 140 blown onto the continuous sheet 110 from the air knives 124 even when the control for stopping the power supply to the infrared heater 123 does not function effectively, or even when the interruption of the power supply path performed by the thermostat does not normally function, the heating operation by the infrared heater 123 is performed (As long as the apparatus power supply 201 is on), Further, the air knife 124 is heated by the radiant heat from the infrared heater 123. Thus, the air inside the air knife 124 is warmed, and the air having a temperature higher than normal temperature is blown out from the nozzle 132. Thus, the air knife 124 functions as an auxiliary heater of the infrared heater 123 when the continuous sheet 110 is conveyed.

Then, the heating apparatus 120 can prevent a local heating of the continuous sheet 110 by blowing the air onto the continuous sheet 110 even if the air 140 has a temperature higher than normal temperature when the heating operation by the infrared heater 123 is performed even though the conveyance of the continuous sheet 110 is stopped.

In each of the embodiments described above, the example in which the heating object (conveyed member) is the continuous sheet 110 is described. However, the heating object is not limited to the continuous sheet 110, but any member to be heated by the heating apparatus 120 according to the present disclosure may be applied. For example, the heating object may be a printed object, such as a sheet for an electronic circuit board, wallpaper, and prepreg, for example, in addition to a recoding medium (printed object) such as a continuous body, such as a continuous sheet, a roll sheet, and a web, and an elongated sheet material.

Not only an image such as characters or figures is recorded by a liquid such as ink on the member that is conveyed by the printer, but also a meaningless image such as a pattern may be applied onto the member by a liquid such as ink in order for decoration or the like.

Here, the liquid to be applied on the heating object is not particularly limited, but it is preferable that the liquid has a viscosity of less than or equal to 30 mPa·s under a normal temperature and a normal pressure or by being heated or cooled.

Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant.

Such a solution, a suspension, or an emulsion can be, e.g., inkjet ink, surface treatment solution, a liquid for forming components of electronic element or light-emitting element or a resist pattern of electronic circuit, or a material solution for three-dimensional fabrication.

When a liquid discharge head is used as the liquid applicator, examples of an energy generation source discharging a liquid include an energy generation source using a piezoelectric actuator (a lamination-type piezoelectric element and a thin-film piezoelectric element), a thermal actuator using an electrothermal transducer element such as a heating resistor, a static actuator including a diaphragm plate and opposed electrodes, and the like.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A heating apparatus, comprising:

a plurality of heaters to heat a heating object, the plurality of heaters disposed along a conveyance direction of the heating object;

a plurality of air nozzles to blow air onto the heating object, at least one of the plurality of air nozzles disposed between the plurality of heaters;

a blower to supply air to the plurality of air nozzles; and a heating controller to control a heating operation of the plurality of heaters; and an apparatus power supply to supply power to the heating controller via a first power supply route, and to supply power to the blower via a second power supply route, the first power supply route and the second power supply route are separate, wherein the blower supplies the air to the plurality of air nozzles in both cases of when the plurality of heaters performs the heating operation and when the plurality of heaters does not perform the heating operation while the apparatus power supply is turned on so that the air nozzles continue to blow air so long as the apparatus power supply is not turned off.

2. The heating apparatus according to claim 1, wherein the air blown onto the heating object from the plurality of air nozzles passes through a periphery of the plurality of heaters and is discharged outside the heating apparatus.

3. The heating apparatus according to claim 1, wherein the plurality of heaters is arranged in rows in the conveyance direction of the heating object, and the plurality of air nozzles is disposed on an upstream end and a downstream end of the rows of the plurality of heaters in the conveyance direction of the heating object.

4. The heating apparatus according to claim 1, further comprising an exhaust to discharge the air blown onto the heating object outside the heating apparatus, wherein the exhaust discharges the air outside the heating apparatus in both cases of when the plurality of heaters performs the heating operation and when the plurality of heaters do not perform the heating operation.

5. The heating apparatus according to claim 4, wherein power supplied to the exhaust is supplied via a third power supply route and the exhaust is controlled by turning on or turning off the apparatus power supply.

6. A dryer comprising the heating apparatus according to claim 1 to dry the heating object.

7. A printer comprising:

the dryer according to claim 6; and a liquid application unit to apply liquid to the heating object before the heating object is conveyed to the dryer.

* * * * *